United States Patent [19]

Tefka

[11] Patent Number: 4,539,555

[45] Date of Patent: Sep. 3, 1985

[54] FIRE AND SMOKE PROTECTION DEVICE FOR USE IN BUILDINGS

[76] Inventor: Edward E. Tefka, 2135 Southgate, Northfield, Ill. 60093

[21] Appl. No.: 628,459

[22] Filed: Jul. 6, 1984

Related U.S. Application Data

[63] Continuation of Ser. No. 448,096, Dec. 9, 1982, abandoned, which is a continuation of Ser. No. 216,861, Dec. 16, 1980, abandoned.

[51] Int. Cl.[3] ..... G08B 23/00; E05B 45/06

[52] U.S. Cl. ..... 340/500; 340/542; 340/286 R; 340/628; 340/584; 49/31; 116/12; 200/61.64

[58] Field of Search ..... 340/500, 542, 545, 628, 340/632–634, 696, 540, 541, 825.69, 825.72, 584, 286 R, 286 M; 49/26, 31; 116/6, 12, 15, 75, 85, 86, 100; 200/61.62, 61.64, 61.67–61.7, 61.81

[56] References Cited

U.S. PATENT DOCUMENTS

| | | | |
|---|---|---|---|
| 4,007,456 | 2/1977 | Paige et al. | 340/634 |
| 4,048,630 | 9/1977 | Deming et al. | 340/825.69 |
| 4,074,269 | 2/1978 | Hartley | 340/825.69 |
| 4,197,675 | 4/1980 | Kelly | 340/634 |

*Primary Examiner*—Donnie L. Crosland
*Attorney, Agent, or Firm*—Norman Lettvin

[57] ABSTRACT

An anti-security control for unlocking the normally locked door which separates the corridor side and the stairwell side of buildings, such as hotels. The anti-security control is preferably adapted for use with and draws power from any conventional-type of smoke and fire detection and alarm system. When the detection and alarm system senses the existence of a dangerous level of smoke or fire, current is shunted to a solenoid which operates to unbolt the normally locked separation door. A depressible button may be operatively affixed on the corridor side of the door to provide access from corridor to the stairwell regardless of whether a smoke or fire condition is sensed by the detection system.

10 Claims, 3 Drawing Figures

FIG. 1
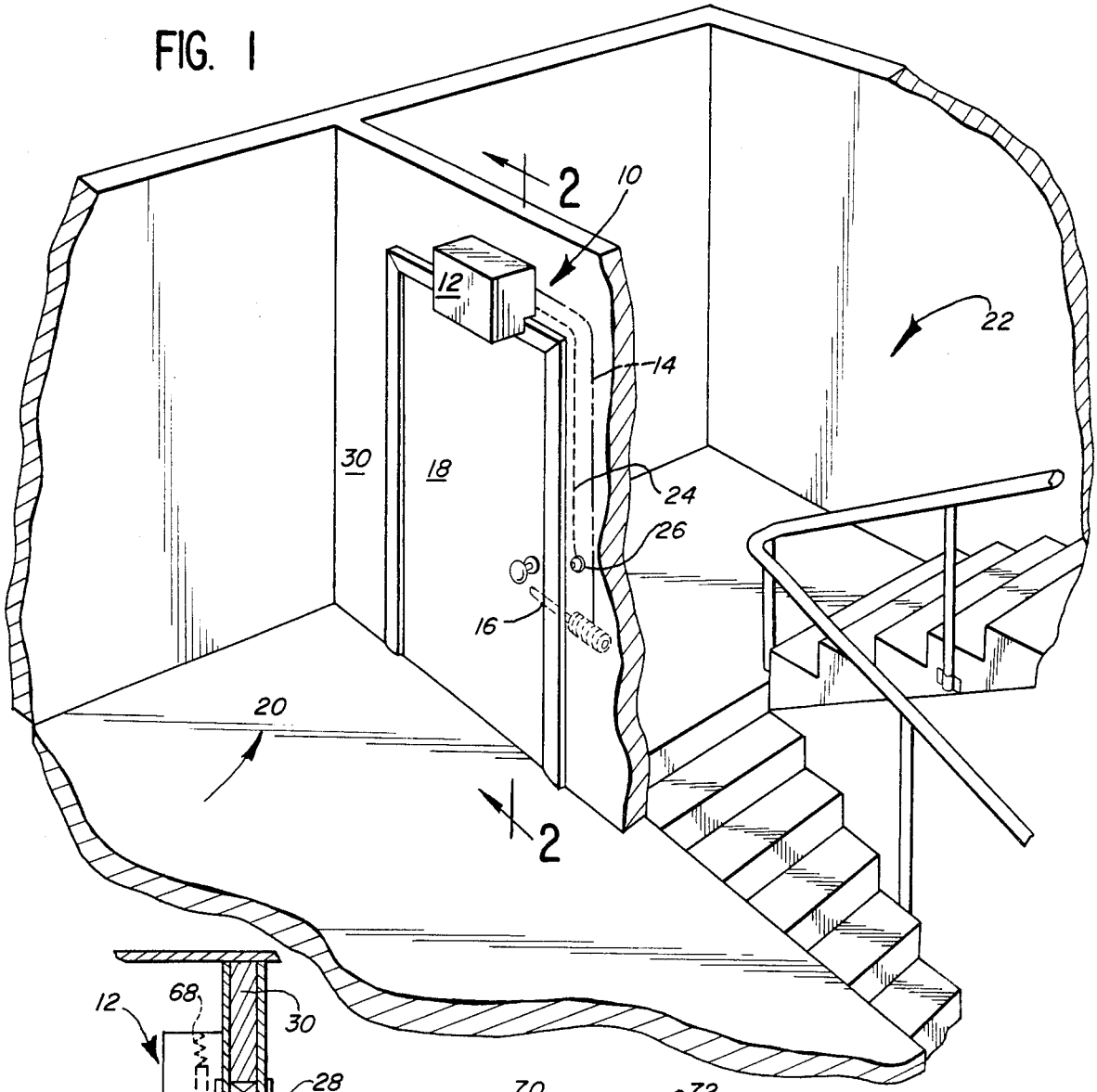
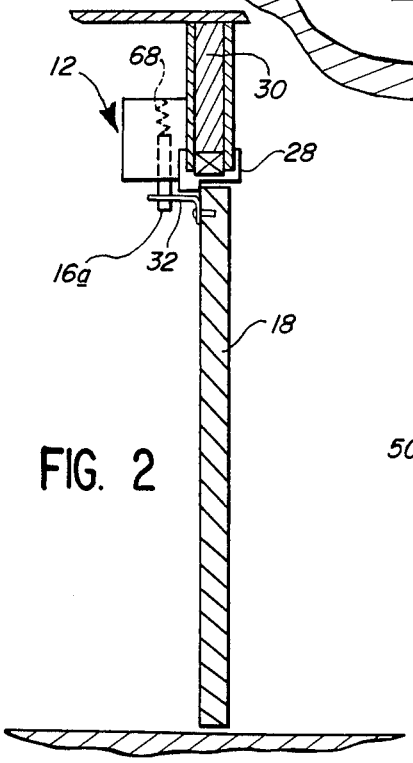
FIG. 2
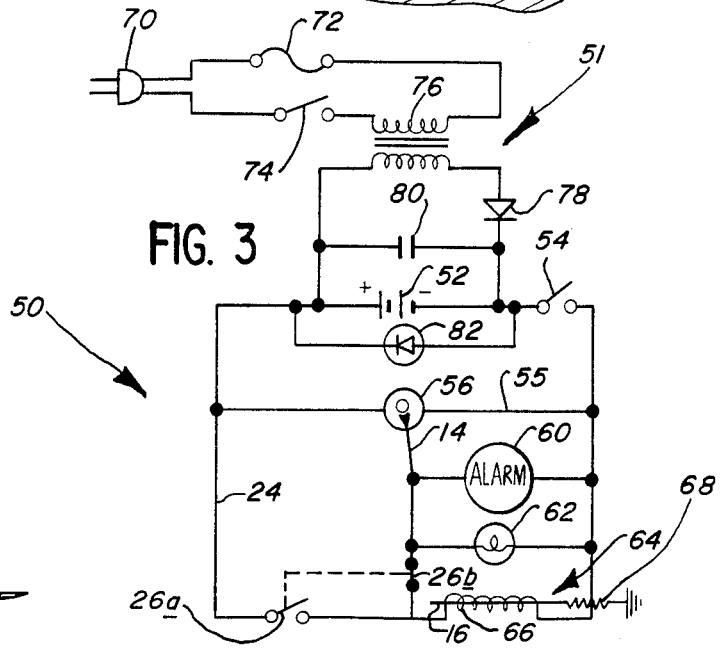
FIG. 3

FIRE AND SMOKE PROTECTION DEVICE FOR USE IN BUILDINGS

This application is a continuation of Ser. No. 448,096 filed Dec. 9, 1982, now abandoned which in turn was a continuation of Ser. No. 216,861 filed Dec. 16, 1980 now abandoned.

FIELD OF THE INVENTION

This invention relates generally to security systems for buildings, and more particularly, to a device for unlocking the normally locked door which prevents free access between the corridor side and the stairwell side of a hotel when dangerous levels of fire or smoke are detected.

BACKGROUND OF THE INVENTION

Hotels, apartments, offices, condominiums, and other similar multi-level buildings include doors which separate the corridor side from the stairwell side of the building. Those doors commonly include one-way security locks which are openable from the corridor side so as to enable people already in the building to use the stairwell exits, while preventing people on the stairwell side from gaining access to the rooms located on the corridor side.

Whereas the one-way security locks serve the useful purpose of denying corridor access to unauthorized people, the security locks have also proved hazardous during unexpected danger conditions. For instance, if the building exit at the base of a stairwell becomes impassable due to fire, all of the people attempting to exit from that stairwell are foreclosed from reentering the corridor because of the security locks, and therefore face serious injury from the spreading fire and smoke.

It is therefore one object of the present invention to provide an anti-security control which is operable in emergency situations to open the normally locked hotel door to permit people to pass from the stairwell side to the corridor side thereof.

Most states now require the installation of smoke and/or fire detecting and signalling devices in public buildings. Such detecting and signalling devices have been used in combination with other components as, for example in U.S. Pat. No. 4,216,468, to detect and signal the rise of water above a preselected flood indicative danger level. Since these detecting and signalling devices are equipped with a self-contained power source and since they are adapted for activation when smoke and/or fire contions exist, it would be clearly advantageous to use the devices in combination with the present invention to draw power to the anti-security control at such times that a danger condition is sensed.

Accordingly, it is a further object of the present invention to provide an anti-security control which is powered by and which is operable when a smoke and/or fire detecting and signalling device senses a dangerous level of smoke and/or fire.

It is yet another object of the present invention to provide an anti-security control which is operable to automatically open a locked door when a smoke and/or fire condition is sensed and which is also equipped with a release mechanism for manually opening a locked door regardless of whether the danger condition is sensed.

These and other objects and advantages of the present invention will become apparent from the following detailed description of the preferred embodiment of the invention.

BRIEF SUMMARY OF THE INVENTION

There is disclosed herein an anti-security control which is adapted for use with a hotel-type security system wherein a door restricts free passage between the corridor and stairwell sides thereof. The control is connected to a conventional smoke and/or fire detecting and signalling device so as to be operable at such times that the detecting and signalling device senses a predetermined level of smoke or heat. When operative, the control draws power from the self-contained power source of the detecting and signalling device to retract a bolt which is normally biased to lock the door. A second bolt retraction mechanism is provided so that the normally locked door may be manually opened from the corridor side thereof. And finally, an AC power adapter may be used to draw AC current from an electrical wall outlet, convert the current to DC and use the DC current to continually charge the self-contained power source of the detecting and signalling device.

BRIEF DESCRIPTION OF THE DRAWINGS

FIG. 1 is a perspective view illustrating a preferred location for the anti-security control of the present invention and showing the door-locking bolt horizontally positioned to extend directly into one side of the hotel door;

FIG. 2 is a cross-sectional view taken along line 2—2 of FIG. 1 showing the door-locking bolt vertically positioned above the door and extending into a bracket secured adjacent the top edge of the door; and FIG. 3 is a schematic of the electrical circuit for operating the anti-security control of the present invention.

DETAILED DESCRIPTION OF THE INVENTION

Referring now to the drawing and particularly to FIG. 1, the anti-security control of the present invention is depicted generally by the reference numeral 10. Control 10 includes a black box 12 connected by a first wire 14 to a horizontally movable bolt 16 biased to normally lock door 18 which separates and blocks free access between the interior corridor 20 and a stairwell corridor 22 of a hotel or other public building. The control box 12 is connected by a second wire 24 to a release button 26 which is then connected to the movable bolt 16. The operation of the bolt 16 will be explained hereinafter.

Turning to FIG. 2, a second embodiment of the anti-securing control 10 of the present invention is shown as affixed to the door frame 28 on the wall 30 which separates the corridor 20 from the stairwell 22. In this embodiment, a movable bolt **16*a* is vertically positioned adjacent the control box 12 above the door 18 so as to be normally received within an aperture in an L-shaped bracket 32 secured to the corridor side 20 of the door 18. The bolt 16*a* is movable between the door-locking position shown in FIG. 2 and a door-release position wherein the bolt moves out of the apertured bracket 32 to permit the door 18** to be opened.

It is to be understood that, although the bolt 16 is illustrated as being positioned in the plane of the door framing wall 30 on the handle side of the door 18 in FIG. 1 and the bolt **16*a* is illustrated as being positioned above the door 18 in FIG. 2**, the bolt may be positioned at any point about the periphery of the door, whether within or without the door frame, without departing from the spirit and scope of the instant invention.

In FIG. 3, the electrical circuit for the antisecurity control 10 is indicated generally at 50. An AC adapter shown generally as 51 for adapting an AC source of power, such as the power from a common 110 volt electrical outlet, may be used to power the control 10. However, because external power may be lost during a fire, it is preferred that a rechargeable battery, such as the 9 volt nickel-cadmium battery, illustrated as 52 in FIG. 3, serve as the primary source of power. As explained hereinafter, the AC power source can be employed to continuously charge the battery 52.

The battery 52 is connected in series with an on-off switch 54 which activates the control 10 and with a smoke and/or fire detector and alarm 56 which can be of any well known design and operation. Upon sensing a predetermined level of heat or smoke, the detector and alarm 56 operates to shunt current from line 55, which extends between the detector and alarm 56 and the switch 54, to gate line wire 14. Gate line 14 delivers current to and thereby activates an audible alerting alarm 60. A light 62, for illuminating the corridor area 20 or stairwell area 22 in the event of loss of power to the normal corridor and stairwell lights, is connected in parallel with the alarm 60 and receives current from the gate line wire 14 when the detector and alarm 56 senses a predetermined level of heat or smoke.

A spring-biased solenoid, generally 64, is connected in parallel with the light 62 and the alarm 60 to receive current from the gate-line wire 14 when the detector and alarm 56 senses a predetermined level of heat or smoke. The solenoid 64 includes an energizable coil 66, the translatable bolt 16 (or 16*a*), which becomes operational when the coil 66 is energized, and a spring 68 which normally biases the bolt 16 into the door-locking position. When current flows through gate line wire 14 to energize the coil 66, the bolt 16 moves against the bias of spring 68 to release the door 18 from its locked position.

The AC adapter 51 includes a plug 70 adapted to be inserted into an electrical outlet, a fuse 72 adapted to provide safety in the event of an overload, an on-off switch 74 adapted to activate the adapter 51, a step-down transformer 76, a diode 78 and a capacitor 80. The AC adapter 51, connected on opposite sides of the battery 52, receives the AC signal, transforms the signal to DC, converts the transformed signal to half-wave, and finally smoothes the half-wave signal to recharge the nickel-cadmium battery 52. A light-emitting diode 82 may be connected across the battery 52 to provide a visual indication that power is being supplied to the control system and the system is operational.

The release button 26 operates to unlock the normally locked door 18 regardless of whether smoke and/or fire conditions have been sensed by the smoke and/or fire detector and alarm 56. The button 26 is connected in parallel with the detector and alarm 56 so as to receive current directly from the power source 52. The button 26 is a double pole switch having one normally open contact 26*a* and one normally closed contact 26*b*. The contacts are synchronized such that depressing the button 26 (a) closes normally open contact 26*a* to pass current through bypass line 24 and activate solenoid 64 for opening the normally locked door 18 and (b) opens normally closed contact 26*b* to prevent current from reaching and activating the alarm 60 and the light 62.

Although not illustrated, it should be apparent that a manual release mechanism, such as a release latch positioned within the removably covered box 12, is within the scope of the present application. The manual release mechanism would be available to unlock the door 18 in the event that both the AC power source and the DC battery failed.

The electrical circuit 50 is merely exemplary. The ordinarily skilled artisan could achieve numerous modifications of said circuit without changing the operation of the components thereof. This application is intended to incorporate all such changes without departing from the spirit of the invention.

Operation

The anti-security control 10 may be installed on one or both sides of the normally locked door 18 which separates and prevents free access between the corridor side 20 and the stairwell side 22 of a hotel or other public building. In the event that the detector 56 senses a dangerous level of smoke and/or the existence of a fire, (a) the alarm 60 is activated to alert people of the danger, (b) one or more lights 62 become operative to illuminate the corridor and/or stairwell areas should the regular lighting fail, and (c) the solenoid 64 is activated to open the normally locked door 18 to provide free access to alternate escape routes for people who otherwise could be trapped on one of the sides of the locked door 18.

By plugging the AC adapter 51 into a conventional AC electrical outlet, the battery 52 is continuously charged to its capacity for those instances in which it must be used to power the anti-security control 10 because a fire has caused a loss of external power.

Since it is also desired that the normally locked door 18 be openable to provide access to the stairwell to people on the corridor side 20 of the hotel wall 30, the release button 26 is supplied. When the button 26 is depressed, the solenoid 64 causes movable bolt 16 to be withdrawn from the door-locking position and enables people to travel from the corridor area 20 to the stairwell area 22. After a predetermined length of time, the double pole switch 26 resets and the bolt 16 returns to its normal spring-biased, door-locking position.

While one form of the invention has been described, it will be understood that the invention may be utilized in other forms and environments, so that smoke detection may also be interpreted to be sensing of any dangerous gas that can be detected, and so the purpose of the appended claims is to cover all such forms of devices not disclosed but which embody the invention disclosed herein.

What is claimed and desired to be secured by Letters Patent of the United States is:

1. For use with a hotel-like security system in which a normally closed, but manually physically movable, framed door blocks free access between a corridor area and a stairwell area of a hotel or other building, the improvement of an anti-security control that is to be activated only under smoke and/or fire conditions, comprising, in combination:

movable bolt means positioned for normally securing the door in a closed, locked position within its frame, to prevent any manual movement of the door that could provide selective access between the stairwell and corridor in the absence of a smoke and/or fire condition, said bolt means including biasing means for normally biasing said bolt means into a locked position;

means for supplying electric power to the anti-security control;

detector means responsive to smoke and/or fire conditions sensed in either of the two said areas separated by the closed door, said detector means being operatively connected to said power means and including gating means for gating power when smoke and/or fire conditions are sensed;

signal means for providing an alerting audible signal when smoke and/or fire conditions are sensed, said signal means being operatively connected to said gating means; and release means for automatically moving said bolt means against said biasing means to release the door from its normally locked condition, without opening the door when a dangerous smoke and/or fire condition is sensed by said detector means, said release means being operatively connected to said gating means, whereby, when the detector means senses a dangerous smoke and/or fire condition, said gating means shunts power to energize both said signal means and said release means to thereby provide an audible alerting signal and also permitting selective manual opening movement of the door, to permit selective access by a person between the corridor and the stairwell side of the hotel, or other hotel-like building.

2. The anti-security control system of claim 1 further including second release means for unlocking a normally locked door, said second release means adapted to be manually actuated to unlock said door regardless of whether smoke and/or fire conditions have been sensed by the detector means.

3. The anti-security control system of claim 1, wherein the power means is a rechargeable nickel-cadmium battery.

4. The anti-security control system of claim 1, wherein the power means is a 110 volt AC outlet, the current from which is transformed, converted to half-wave and smoothed to charge a nickel-cadmium battery.

5. The anti-security control system of claim 1, wherein the first release means is a spring-biased solenoid, including a movable plunger normally biased in a door-locking position, the plunger adapted to withdraw from the door-locking position when the solenoid is energized.

6. The anti-security control system of claim 1, wherein the alerting signal means provides an audio signal.

7. The anti-security control system of claim 1, further including a light emitting diode for indicating that the circuit is operational.

8. The anti-security control system of claim 1, further including means for lighting a predetermined area when smoke and fire conditions are sensed, said lighting means being operatively connected to said gating means.

9. An improved anti-security control for use with a hotel-like security system for a hotel or other building, in which a framed security door, constructed only for a person to effect selective manual physical movement thereof, normally is closed and blocks free access between an outside hotel stairwell to an inside hotel corridor and is substantially constantly locked, for security purposes, by a movable latch means that is operatively associated with the door and is normally biased to a closed-latch position by said security system, so as to prevent unauthorized selective manual movement of the door from the hotel's outside stairwell, and said movable latch means being movable to a non-latching position;

said improved anti-security control being constructed and arranged to be automatically activated only under smoke and/or fire conditions, and comprising, in combination:

a detector means that is responsive to smoke and/or fire conditions in any of the inside corridor or outside stairwell of the hotel or building, an electric power supply that has the power capacity to override that portion of the hotel-like security system that normally latches the framed security door when the door is in its closed position, said latch means including a locking bolt normally spring biased to a locking position;

and means operatively associated with the said electric power supply, the said detector means, and the said movable locking bolt to override the biasing spring portion of the hotel-like security system which bolts the security door in its closed position, and leaving the door closed, by moving said movable bolt against said biasing spring to an inoperative position but only when a dangerous smoke and/or fire condition in the hotel is sensed by said detector means, thereby leaving said security door in its normally closed attitude but unlocked so as to permit a person to thereafter selectiely use the security door as a manually openable door, from the stairwell to the corridor and vice versa, and through which the person may seek shelter on either side of the security door as conditions demand.

10. A construction as in claim 9 including a signalling means operatively associated with the detector means, for audibly alerting a person to the fact that the signalling means is responding to presence of a smoke and/or fire condition that will automatically de-activate the hotel-like security system that normally bolts the security door in the door's closed position.

* * * * *